United States Patent [19]

Moore et al.

[11] 4,392,689

[45] Jul. 12, 1983

[54] PAVEMENT MILLING APPARATUS

[76] Inventors: Robert H. Moore, 231 Hamlet St., Los Angeles, Calif. 90042; Larry O. Engels, 90564 Link Dr., Eugene, Oreg. 97402

[21] Appl. No.: 255,710

[22] Filed: Apr. 20, 1981

[51] Int. Cl.[3] ..... E21C 47/00

[52] U.S. Cl. ..... 299/39; 299/71

[58] Field of Search ..... 299/39–41, 299/80, 71; 51/176

[56] References Cited

U.S. PATENT DOCUMENTS

| | | | |
|---|---|---|---|
| 3,107,460 | 10/1963 | Staehlin | 51/176 |
| 3,560,050 | 2/1969 | Lockwood | 299/39 |
| 3,895,843 | 7/1975 | Wall et al. | 299/39 |

FOREIGN PATENT DOCUMENTS

| | | | |
|---|---|---|---|
| 1336 | of 1899 | United Kingdom | 299/39 |

*Primary Examiner*—Ernest R. Purser

*Attorney, Agent, or Firm*—William W. Haefliger

[57] ABSTRACT

Apparatus including a vehicle and rotor means carrying cutter structure is provided, for removing pavement in linear trench configuration or configurations.

14 Claims, 8 Drawing Figures

PAVEMENT MILLING APPARATUS

BACKGROUND OF THE INVENTION

This invention relates generally to pavement removal or destruction, and more specifically concerns equipment usable to mill pavement such as runways, roads etc.

Pavement such as runways frequently deteriorates as by local cracking and spalling to the point that repair is required. Also joints between concrete slabs deteriorate so that removal of joint sealer and cutting away of local areas is necessary, followed by pouring of concrete or other material into the removal zone. In the past, local pavement removal was typically carried out using human labor and with jackhammers, picks and shovels, so that progress was very slow, and expensive. Accordingly, there is need for equipment to rapidly and accurately form trenches in deteriorated pavement zones, without damage to adjacent sound pavement, so that fresh concrete or other material can be filled into such trenches.

SUMMARY OF THE INVENTION

It is a major object of the invention to provide equipment or apparatus that will meet the above need, so that rapid repair of pavement can be accomplished. For example, equipment in accordance with the invention will typically enable milling away of deteriorated concrete and joint sealer pavement at the rate of 5000 feet per hour.

As will appear, the equipment basically comprises:

(a) a vehicle adapted to be driven over the pavement, (b) milling rotor means and drive means therefor, the milling rotor means including cutters projecting at the periphery of the rotor means for cutting the pavement as the rotor means is driven in rotation, (c) structure on the vehicle carrying the milling rotor means for adjustable bodily displacement relative to the vehicle and to selected positions wherein vehicle weight is exerted downwardly on the milling rotor means during cutting of pavement.

The above structure typically includes first actuator means connected with the rotor means, as for example two milling rotors, a via supporting links, to displace the rotors downwardly and upwardly relative to the vehicle. Thus, the rotors can be displaced downwardly and forwardly for vertical cutting of pavement edges, or displaced upwardly for pavement wall sawing or grinding. Also, the rotor or rotors and first actuator means are typically carried by arbor structure for lateral adjustment, or displacement relative to the vehicle; and second actuator means are provided to effect such lateral adjustment of the arbor structure, whereby accurate lateral positioning of the milling or trenching rotors may be accomplished, coincident with longitudinal travel of the vehicle during milling. Ballast may be provided on the vehicle to exert downward loading on the milling rotor or rotors, and a removable hood or body is applicable to the vehicle frame. Finally, an additional scraper or rooter may be carried on the vehicle as will be described.

These and other objects and advantages of the invention, as well as the details of an illustrative embodiment, will be more fully understood from the following description and drawings, in which:

DRAWING DESCRIPTION

Figure 1:
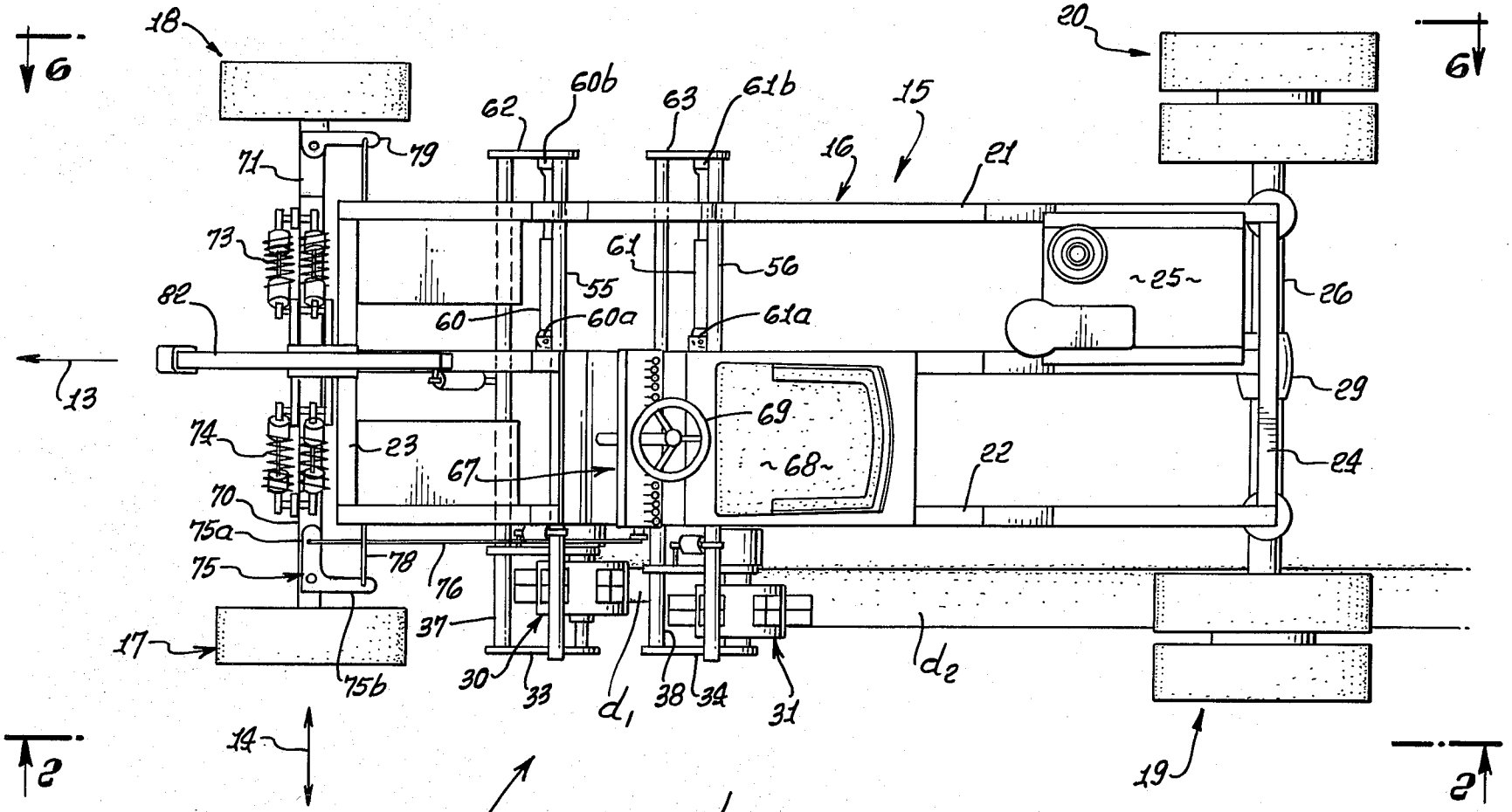
FIG. 1 is a plan view of one form of pavement removing equipment embodying the invention.
Figure 2:
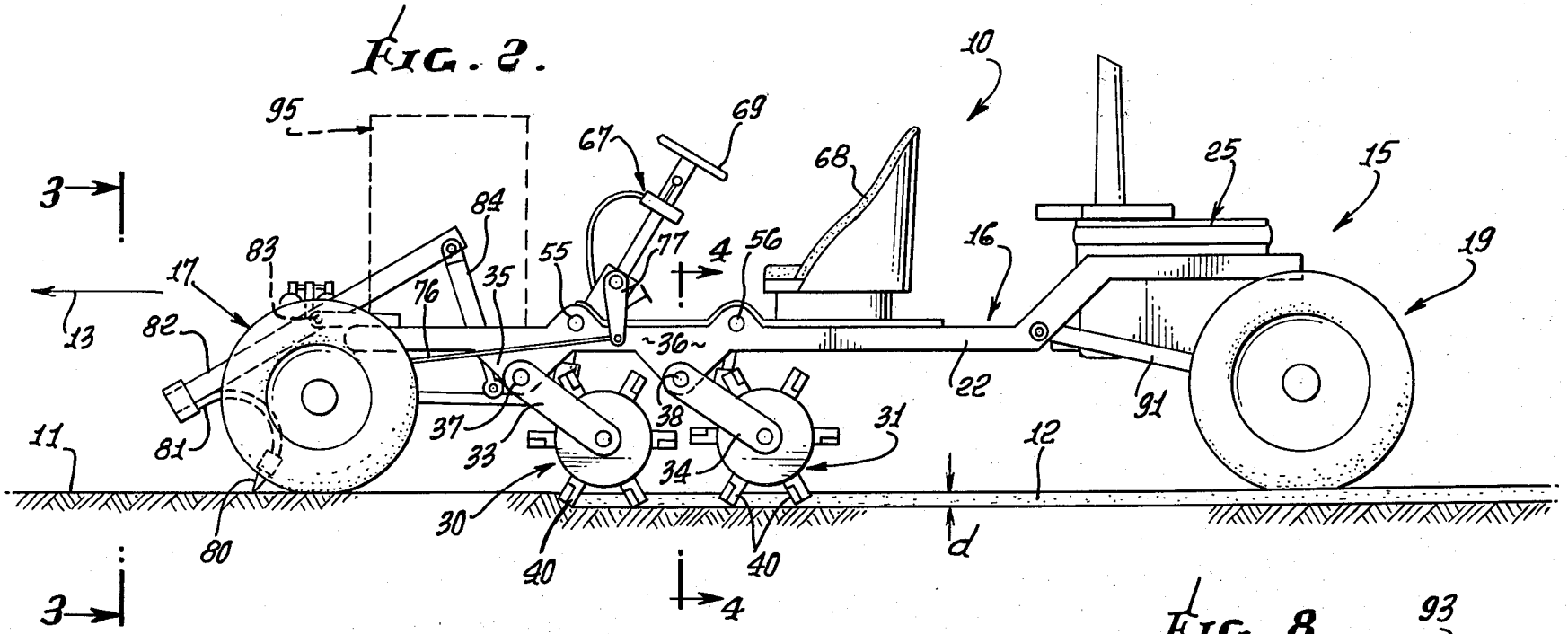
FIG. 2 is a side elevation taken on lines 2—2 of FIG. 1.
Figure 2A:
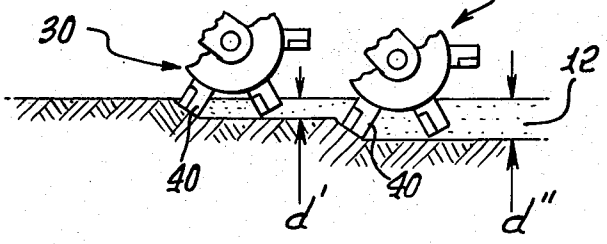
Figure 3:
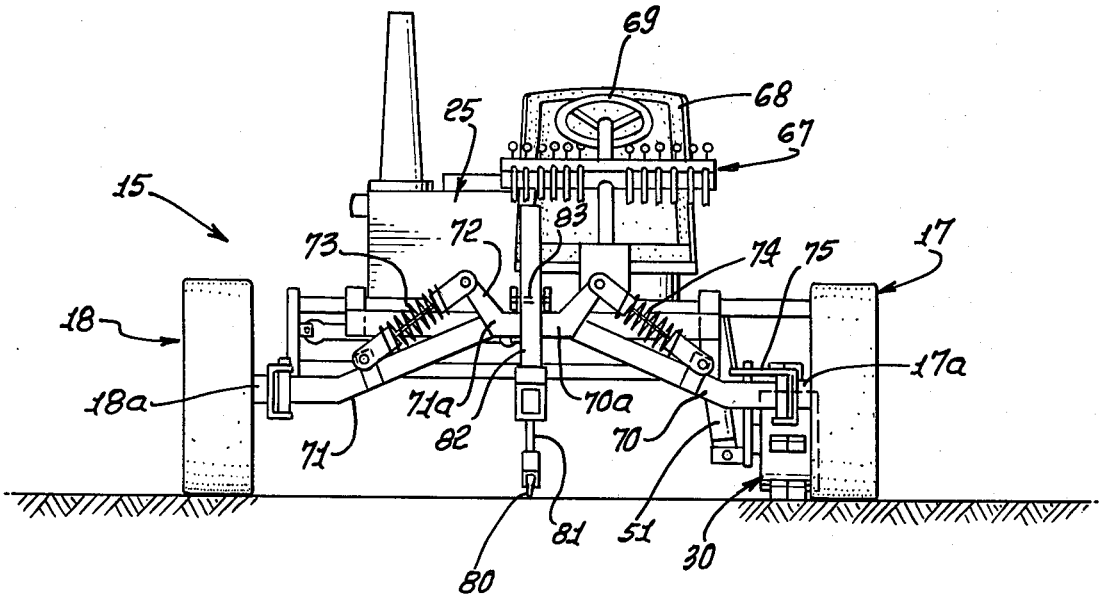
Figure 4:
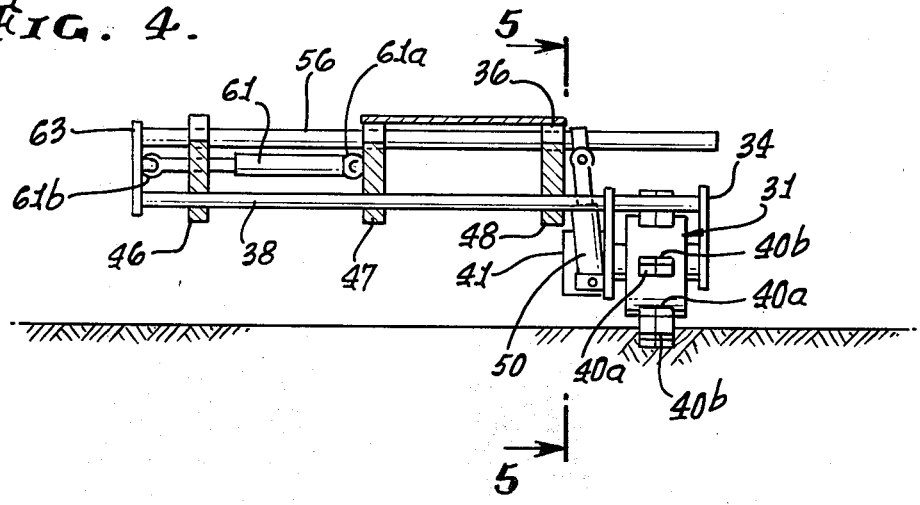
Figure 5:
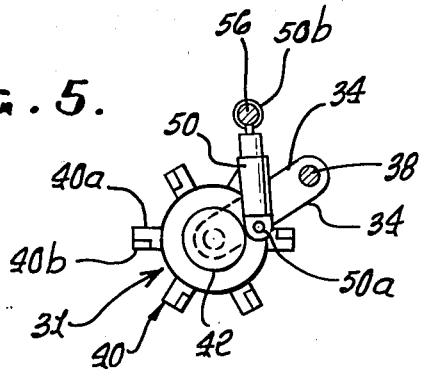
Figure 6:
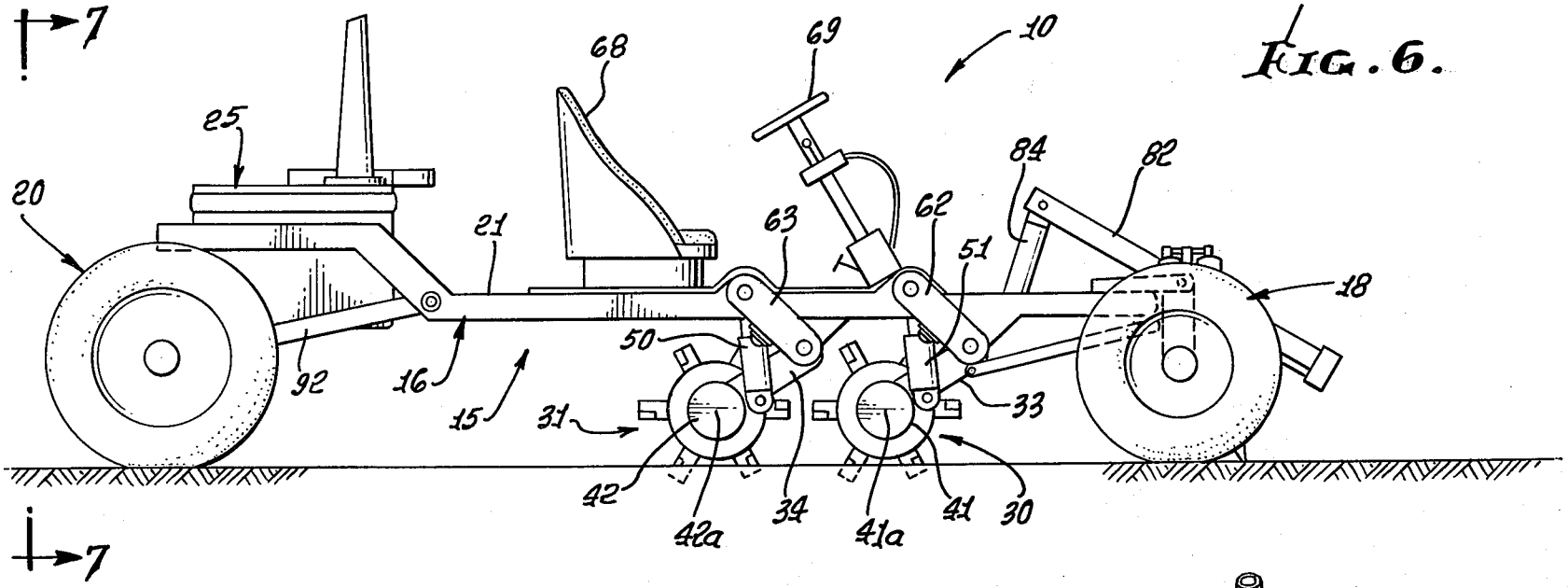
Figure 7:
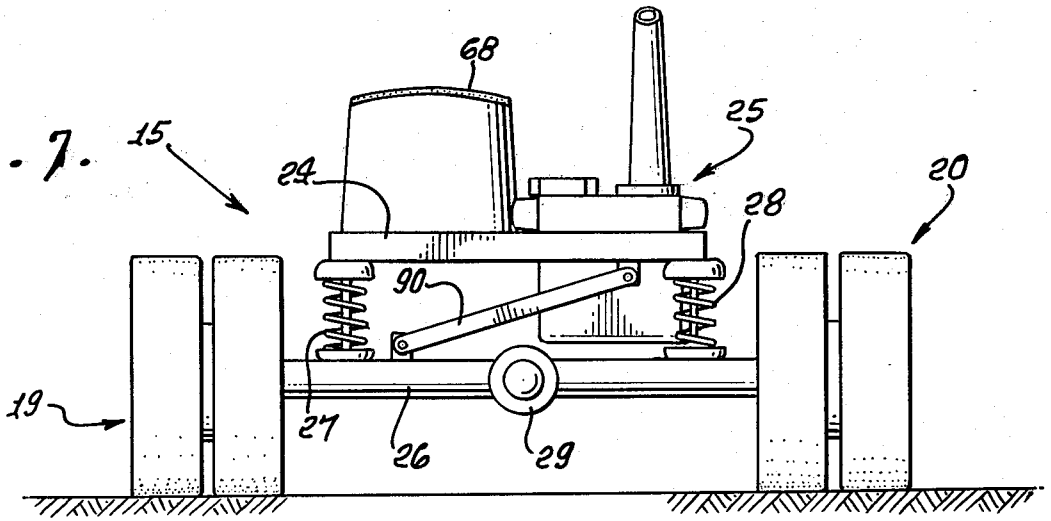

FIG. 2*a* is a fragmentary elevation;

FIG. 3 is a frontal elevation taken on lines 3—3 of FIG. 2;

FIG. 4 is a vertical section taken on lines 4—4 of FIG. 2;

FIG. 5 is an elevation taken in section on lines 5—5 of FIG. 4;

FIG. 6 is a side elevation taken on lines 6—6 of FIG. 1;

FIG. 7 is a rear elevation taken on lines 7—7 of FIG. 6; and

Figure 8:
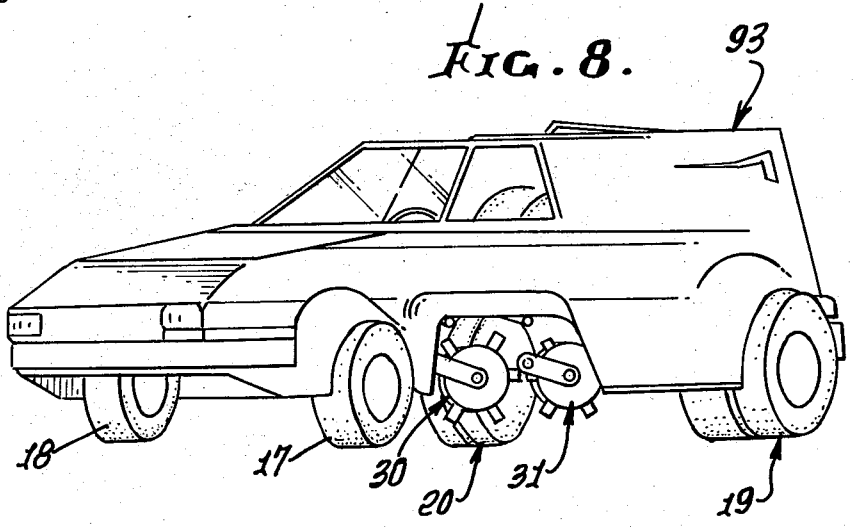

FIG. 8 is a perspective view showing a vehicle body emplaced onto the equipment frame of FIGS. 1–6.

DETAILED DESCRIPTION

In the drawings, the equipment 10 for removing pavement 11 is adapted to form a trench 12 as seen in FIG. 2, of selected depth d, with sidewardly offset or staggered portions $d_1$ and $d_2$ (see FIG. 1). The equipment is also adapted to produce a trench having two selected different depths d′ and d″, respectively associated with staggered portion $d_1$ and $d_2$. See FIG. 2*a*. Each such trench is formed to extend longitudinally in the direction of vehicle travel, indicated by arrow 13. Also, the trench location may be adjustably shifted laterally, in the direction of arrow 14 in FIG. 1, as will appear.

The equipment 10 includes a vehicle 15 having a frame 16 and wheels 17–20, enabling the vehicle to be driven over the pavement during the trench or pavement cutting operation. As illustrated the frame includes horizontally longitudinally elongated members 21 and 22, and horizontally laterally elongated members 23 and 24. A drive for the rear wheels includes internal combustion engine 25 mounted near the rear of the vehicle. Rear wheel axle housing 26 extends beneath rear frame member 24, and is spring suspended at 27 and 28. Two pairs of 19 and 20 rear wheels are employed, and gearing in housing 29 is connected between the engine and rear wheel axles. FIGS. 2 and 6 also show links 91 and 92 pivotally connected between the frame and the axle housing 26. See also link 90 in FIG. 7, between 24 and 26.

In accordance with the invention, milling rotor means is carried by structure on the vehicle frame for adjustable bodily displacement relative to the vehicle and to selected positions in which vehicle weight is exerted downwardly on the rotor means during cutting of pavement. In this regard, drive means for the milling rotor means rotates the latter so that peripherally projecting cutters engage and cut into the pavement as the rotor means is driven in rotation. In the example, primary and secondary milling rotors 30 and 31 are independently pivotally suspended by links or arms 33 and 34 from frame parts 35 and 36, as by means of transverse arbors 37 and 38 acting as pivots. Additional milling rotor assemblies may be added for increase of capacity. The arms extend rearwardly and downwardly relative to the vehicle, so that as they are swung downwardly, in vertical planes, the rotors are displaced relatively downwardly and forwardly. Note that the two rotors may be staggered, sidewardly, relative to one another, so that two offset trench portions may be simultaneously cut, if desired, or alternatively either trench portion may be cut while the other remains uncut. Thus, if cracked section of pavement continue for one length and then widens along another length, one milling rotor may be employed to cut out the cracked section along said one length, and then both rotors may be employed to cut away the widened section along its other length, all while the vehicle travels forwardly.

Each rotor includes a series of cutters 40 projecting at the rotor periphery for cutting away pavement (as for example concrete) as the rotor is rotated. Independent drives for the rotors may typically comprise hydraulic or electric motors 41 and 42 best seen in FIG. 6, and carried by links 33 and 34 and located in proximity to the rotors. Thus, the motors may be directly connected to the rotors, as shown, to rotate them about horizontal axes 41*a* and 42*a*. As seen in FIGS. 4 and 5, the replaceable cutters may comprise steel bodies 40*a* carrying hardened (carbide) tool bits 40*b*, tips or diamond or abrasive blades etc., to engage the pavement. This tooling used singularly or in groups "gang style" can maintain whatever width is desired for each rotor assembly.

The structure on the vehicle carrying the milling rotors include forward and rearward, parallel and transverse arbor members or rods 37 and 38, defining parallel axes about which the links 33 and 34 are pivotable. As is clear from FIG. 4, the arbor member 38 is carried by frame structure 46–48 to project or extend sidewardly of the frame, and a pair of links 34 suspends rotor 31 from that arbor. In similar manner, a pair of links 33 rotatably suspends rotor 30 from the arbor member 37.

The structure carrying the rotors for adjustable displacement may advantageously comprise first actuator means operatively connected with the rotors to displace them generally downwardly (and also forwardly due to their link suspension as described) relative to the vehicle. That actuator means is shown to comprise two actuators 50 and 51 having their lower ends respectively operatively correspond with the two rotors, as by connection to the links therefor. See for example FIG. 5, wherein linear actuator 50 has its lower end pivotally connected at 50*a* to a link 34 for rotor 31. The actuators may for example be hydraulic actuators which are extensible and confractible.

The structure also is shown to include two secondary arbor members 55 and 56, which extend laterally in parallel relation, and also carried by the frame parts 46–48, as seen in FIG. 4. The arbor members 55 and 56 are pivotally connected to the upper ends of the actuators 50 and 51. See FIG. 5 and the pivotal connection 50*b*, for example. FIGS. 1 and 4 also show second actuator means, as for example linear hydraulic actuators 60 and 61 operatively connected via headers 62 and 63 with the arbors, to selectively and independently laterally shift or adjust the rotors and their primary actuators, whereby the pavement trench width may be controlled, and also the lateral position of the trench relative to the vehicle frame position may be controlled. Thus secondary actuator 60 controls lateral shifting of arbors 37 and 55, and thus of rotor 30 and its primary actuator 50, and secondary actuator 61 controls lateral shifting of arbors 38 and 56, and thus of rotor 31 and its primary actuator 51. First ends 60*a* and 61*a* of the actuators 60 and 61 are suitably connected to the frame structure 47 (see FIG. 4) and second ends 60*b* and 61*b* of the actuators 60 and 61 are connected to the headers 62 and 63, as shown. A master control for the actuators and motors 41 and 42 is shown at 67, in FIG. 1, with toggle levers to set the actuators in selected positions for trench locations, trench width, and trench depth (one or two levels, as described), and to control motor torque and speed. See also the operator's seat 68, and vehicle steering wheel 69.

The vehicle front wheels 17 and 18 have axles 17*a* and 18*a* which are independently suspended relative to and from the frame. Thus the transverse axle carriers 70 and 71 are pivoted at 70*a* and 71*a* to a plate 72 rigidly connected to the frame, and springs 73 and 74, and air or hydraulic suspension units to pre-load one side or the other, are also mounted between the carriers 70 and 71 and extensions of that plate or member or yieldably resist upward displacement of the wheels, as is clear from FIG. 3. The connections of carriers 70 and 71 seen at 70*a* and 71*a* may be to torsion bars parallel to the frame members 21 and 22. Steering is accomplished via bell crank 75 mounted to pivot about a king pin vertical axis and supporting the axle of wheel 17, to turn with the latter. One arm 75*a* of the crank is connected via rod 76 to mechanism 77 associated with steering wheel 69, whereby rotation of the latter turns wheel 17. A drag link 78 connects the other arm 75*b* of the bell crank with an arm 79 mounted to pivot about a king pin vertical axis and supporting the axle of wheel 18, to turn with the latter, whereby both wheels turn together.

An additional cutter 80 is carried by the vehicle to cut into pavement in spaced relation to the milling rotor, and in response to vehicle advancement. Thus, cutter 80 may be carried at the forward end of the vehicle to project downwardly in a vertical longitudinal plane between wheels 17 and 18. It is shown as suspended via curved spring arm 81, carried by a rocker arm 82 pivoted to the frame at 83. An actuator 84 connected between the frame and arm 82 adjusts the latter about pivot 83, to position the cutter 80 or other hydraulic pneumatic pavement breaker attachments at selected depth. That cutter may also be employed to clear out an already cut trench, or it may be used to first cut away material just above the cracked pavement to be milled out by rotors 30 and 31, or either of them, or other breaker attachments.

Ballast weight (water, metal, etc.) may be applied to the vehicle frame near the milling rotors to add weight and downward loading to the rotors during their operation. See ballast at 95 in FIG. 2.

FIG. 8 shows a removable vehicle body 93 applied downwardly onto the frame, for transportation of the vehicle as under adverse weather conditions. At such times, the rotors 30 and 31 would be raised by the actuators 50 and 51.

In summary, the pavement milling apparatus provides:

(a) adjustable horizontal arbor
(b) infinite speed control
(c) vertical 90° cutting attachment-core drilling and boring
(d) 45° wall sawing and grinding
(e) tooling-single, multiple or gang including:
  (i) carbide cutting heads
  (ii) diamond blades
  (iii) carborundum grinding wheels
  (iv) boring head
  (v) miscellaneous combination of cutters
(f) mobility
  (i) provides multi-function equipment in one unitized package (ii) provides for use of multi-purpose attachments Functional additions are provided by attachments to frame 16. These attachments are an integral and fundamental consideration in the design of this apparatus and therefore are considered to be basic to the integrity of the design. These attachments include but are not limited to the following:

(a) debris collection
(b) sandblasting and blowing and painting
(c) vacuum and sweeping
(d) water blasting and high-pressure binder injection
(e) mortar mixing and distribution
(f) roping and sealing joints in pavement Accordingly, the apparatus is part of a complete system—modular in design.

I claim:

1. In equipment for removing pavement, the combination comprising (a) a vehicle adapted to be driven over the pavement,
(b) milling rotor means and drive means therefor, the milling rotor means including cutters projecting at the periphery of the rotor means for cutting the pavement as the rotor means is driven in rotation, and
(c) structure on the vehicle carrying the milling rotor means for adjustable bodily displacement relative to the vehicle and to selected positions wherein vehicle weight is exerted downwardly on the milling rotor means during cutting of pavement,
(d) the vehicle being oriented for generally longitudinally forward or rearward travel, said rotor means including two rotors at the same side of the vehicle and generally in alignment with one another forwardly and rearwardly,
(e) said structure including first actuator means operatively connected with the rotor means to displace the rotor means generally downwardly relative to the vehicle,
(f) said structure including linkage means suspending the rotor means for downward and forward swinging in response to said operation of the first actuator means,
(g) said structure including primary member means respectively suspending the rotor means for adjustable lateral displacement relative to the vehicle, and at the same side thereof,
(h) and second actuator means operatively connected with said primary member means to effect said adjustable lateral displacement thereof relative to the vehicle.

2. The combination of claim 1 including ballast on the vehicle to exert downward loading on the rotor means during pavement cutting.

3. The combination of claim 1 including an additional cutter-carried by the vehicle to cut into pavement in spaced relation to said milling rotor means, and in response to vehicle advancement.

4. In equipment for removing pavement, the combination comprising (a) a vehicle adapted to be driven over the pavement,
(b) milling rotor means and drive means therefor, the milling rotor means including cutters projecting at the periphery of the rotor means for cutting the pavement as the rotor means is driven in rotation, and
(c) structure on the vehicle carrying the milling rotor means for adjustable bodily displacement relative to the vehicle and to selected positions wherein vehicle weight is exerted downwardly on the milling rotor means during cutting of pavement,
(d) said vehicle being oriented for generally longitudinally forward or rearward travel, and said milling rotor means includes primary and secondary milling rotors one of which is longitudinally offset relative to the other,
(e) said structure including two first actuators respectively operatively connected with the rotors to displace them generally downwardly relative to the vehicle,
(f) said structure including two linkages respectively suspending the two rotors for downward and forward swinging in response to said operation of the two first actuators, and
(g) said structure including two primary members respectively suspending the two rotors for adjustable lateral displacement relative to the vehicle.

5. The combination of claim 4 including second actuator means respectively operatively connected with said members to effect said adjustable lateral displacement thereof.

6. The combination of claim 4 including ballast on the vehicle to exert downward loading on the two rotors via said linkages and said two first actuators, during said pavement cutting.

7. The combination of claim 4 wherein said drive means for the rotors comprise motors carried by said linkages and located in proximity to the rotors.

8. The combination of claim 4 wherein said structure includes two secondary members, parallel to said primary members, respectively suspending the two first actuators for adjustable lateral displacement along with adjustable lateral displacement of the two rotors.

9. The combination of claim 8 including second actuator means operatively connected with said two primary members and the two secondary members to effect simultaneous adjustable lateral displacement of each pair of primary and secondary members.

10. The combination of claim 9 wherein said two primary members and said two secondary members comprise parallel, transversely elongated arbors from which the two rotors are suspended via said links all at one side of the vehicle.

11. The combination of claim 9 wherein said second actuator means includes two independently operable second actuators, one of which is connected to the primary and secondary members associated with one rotor, and the other of which is connected to the primary and secondary members associated with the other rotor.

12. In equipment of the character described, and including a vehicle, the combination comprising (a) rotary cutter means to cut a longitudinal trench in pavement as the vehicle advances,
(b) means to control the position of said cutter means to control the depth of the trench, and
(c) means to control the position of said cutter means to control the lateral location of the trench relative to the vehicle,
(d) said cutter means including two rotors carrying cutters, the two rotors offset from one another and being independently controllable as to their vertical positions, the two rotors confined at the same side of the vehicle and in general longitudinal alignment.

13. The combination of claim 12 including means to control said cutter means to control the width of the trench.

14. The combination of claim 12 wherein said (c) means includes actuator structure to adjust the relative lateral positions of the two rotors.

* * * * *